US008108946B2

(12) United States Patent
Myers

(10) Patent No.: US 8,108,946 B2
(45) Date of Patent: Feb. 7, 2012

(54) HAND WARMER KNOWN AS "Z" MUFF

(76) Inventor: Amy Myers, Indianapolis, IN (US)

( * ) Notice: Subject to any disclaimer, the term of this patent is extended or adjusted under 35 U.S.C. 154(b) by 0 days.

(21) Appl. No.: 11/881,568

(22) Filed: Jul. 27, 2007

(65) Prior Publication Data

US 2008/0022430 A1 Jan. 31, 2008

Related U.S. Application Data

(60) Provisional application No. 60/834,206, filed on Jul. 28, 2006.

(51) Int. Cl.
*A41D 5/00* (2006.01)

(52) U.S. Cl. ..... 2/66; 2/65

(58) Field of Classification Search ..... 2/65, 66, 2/59, 162, 170, 253
See application file for complete search history.

(56) References Cited

U.S. PATENT DOCUMENTS

| | | | | |
|---|---|---|---|---|
| 95,240 | A | 9/1869 | Levy | |
| 405,097 | A | 6/1889 | Kaehler | |
| 482,432 | A * | 9/1892 | Ashbaugh | 2/66 |
| 2,727,241 | A | 12/1955 | Smith | |
| 4,408,355 | A | 10/1983 | Brock | |
| 4,495,659 | A | 1/1985 | Madnick | |
| D300,984 | S * | 5/1989 | Carter et al. | D2/611 |
| 4,862,519 | A | 9/1989 | Bull | |
| 5,269,023 | A | 12/1993 | Ross | |
| 7,089,617 | B1 * | 8/2006 | Lauro | 5/636 |

* cited by examiner

*Primary Examiner* — Alissa L Hoey
*Assistant Examiner* — Amber Anderson
(74) *Attorney, Agent, or Firm* — Ritchinson Law Office, PC; John D Ritchison

(57) ABSTRACT

A special device for use as an auxiliary accessory to keep ones hands warm and safe from the elements. The device has many variations in size, color and materials anticipated with only minor physical changes for manufacturing. In a cold or a moderating environment with wide temperature variations and exposure to cold, a person often needs a means to protect ones hands from the severe cold temperature. This device provides an economical, efficient and durable way to protect ones hands in the exposed environment. The device is comprised essentially of a piece of "fur-like" cloth (natural or artificial) that is attached by a means (sewn, glued, or the like) to itself in a special configuration and then "inserted and stuffed" within itself to provide a new, special configuration for retaining heat and protecting ones hands. The result is a cost efficient and durable hand warming product.

1 Claim, 6 Drawing Sheets

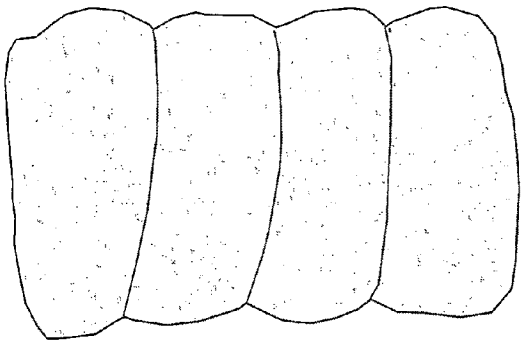
Fig. 1 A
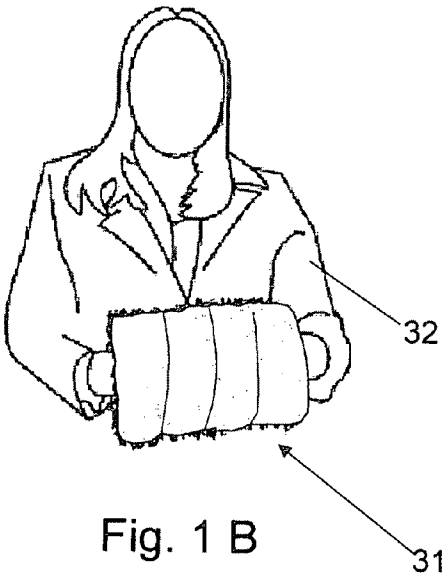
Fig. 1 B
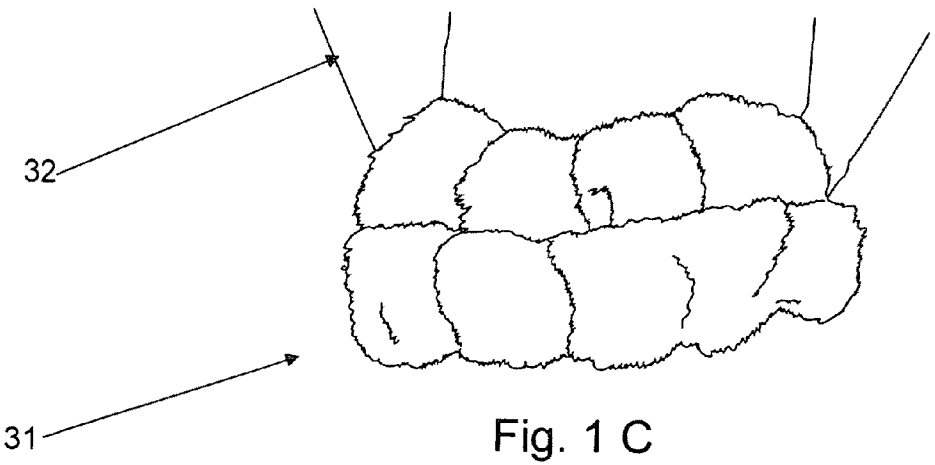
Fig. 1 C
Fig. 1

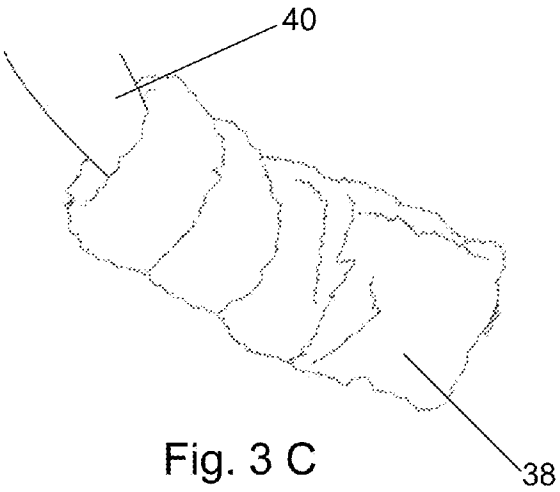
Fig. 3 C
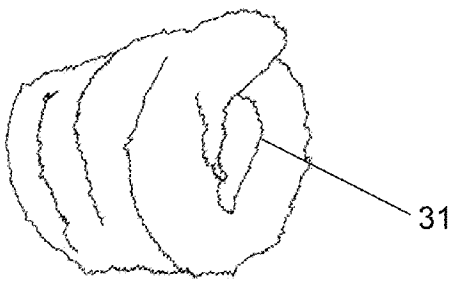
Fig. 3 D
Fig. 3
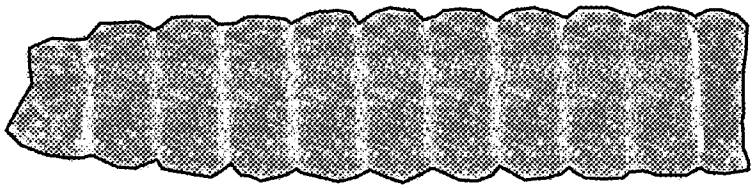
Fig. 3 A
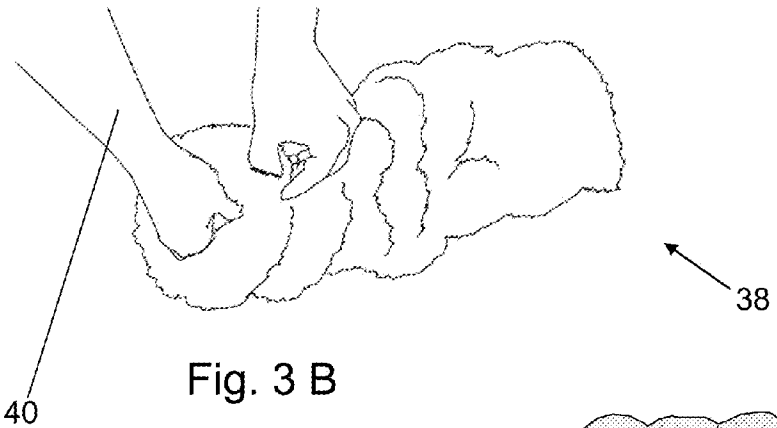
Fig. 3 B
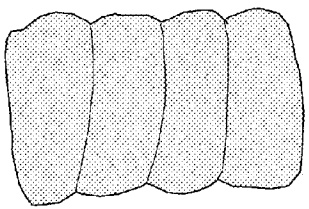
Fig. 1 A REPEATED

Fig. 1 C REPEATED

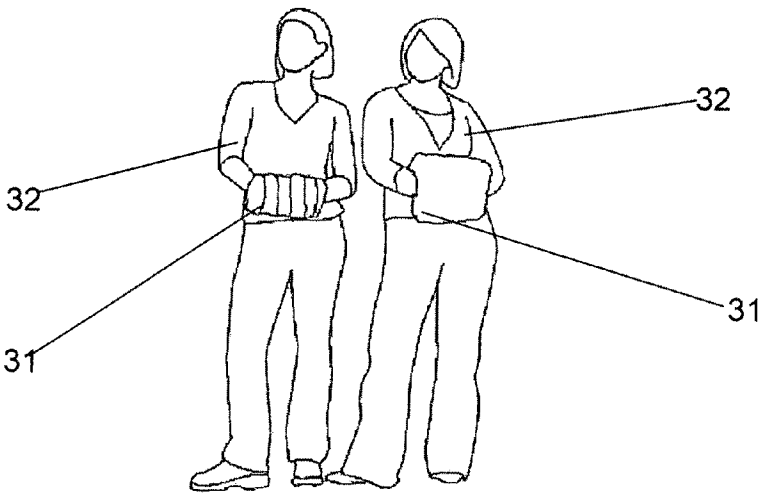
Fig. 5 B
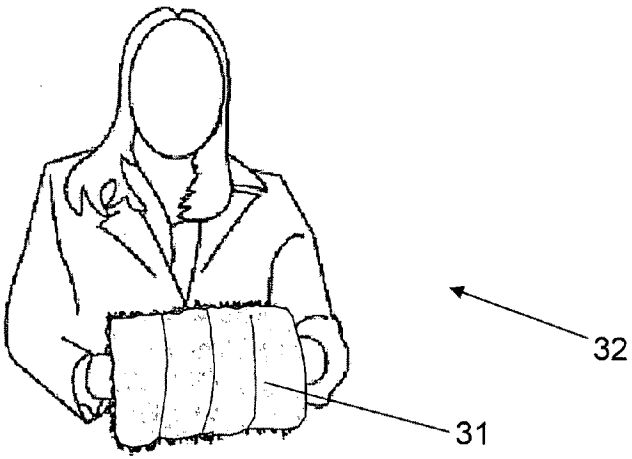
Fig. 1 B REPEATED
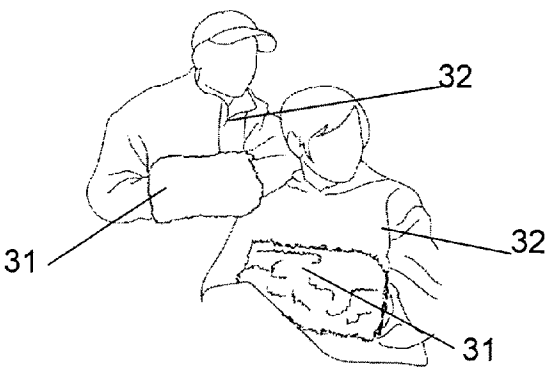
Fig. 5 A
Fig. 5

HAND WARMER KNOWN AS "Z" MUFF

CROSS-REFERENCE TO RELATED APPLICATIONS

This application claims the benefit of Provisional Patent Application Ser. No. 60/834,206 filed Jul. 28, 2006 by Amy Myers, and titled "Improved Hand Warmer device known as Z Muff".

FIELD OF INVENTION

This invention relates to a special Improved Hand Warming Device for use to protect hands and enhance comfort in cold environments. Particularly this new Improved Hand Warming device is related to devices and methods to improve the retention of heat and protection to hands when exposed to a cold environment. This protection is essentially a means to prevent severe exposure to the environment ant to prevent complications there from such as frostbite and the like. Minimally, the special Improved Hand Warming Device known as "Z" Muff provides a comfortable and safe means to achieve warm hands in a colder environment. The device may be featured with various types of materials and colors and achieve the objectives.

FEDERALLY SPONSORED RESEARCH

None.

SEQUENCE LISTING OR PROGRAM

None.

BACKGROUND

Field of Invention and Prior Art

The new device is developed for use as an auxiliary accessory to be use to keep ones hands warm and safe from the elements. Many variations in size, color and materials used are anticipated with this concept with only minor physical changes for manufacturing. The preferred embodiment of the special Improved Hand Warming Device, known as "Z" Muff, is comprised of simple components and easily processed to provide and economical and versatile answer to hand warming devices.

A. Introduction of the Problems Addressed

In a cold environment or a moderating environment with temperature variations and "swings" to cold exposures, a person often needs a means to protect ones hands from the severe cold temperature. This may be for a short or prolonged period of time. Specifically, the special Improved Hand Warming Device known as "Z" Muff provides an economical, efficient and durable way to protect ones hands in the exposed environment. The new and special Improved Hand Warming Device known as "Z" Muff is comprised essentially of a piece of "fur-like" cloth (natural or artificial) that is attached by a means (sewn, glued, or the like) to itself in a special configuration and then "inserted and stuffed" within itself to provide a new, special configuration for retaining heat and protecting ones hands.

A special Improved Hand Warming Device known as "Z" Muff has been developed for use as an auxiliary accessory to be use to keep ones hands warm and safe from the elements. It is important to note that many variations in size, color and materials used are anticipated with this concept with only minor physical changes for manufacturing.

In a cold environment or a moderating environment when temperature variations "swing" to cold exposures, a person often needs a means to protect ones hands from the severe cold temperature. This may be for a short or prolonged period of time. Specifically, the special Improved Hand Warming Device known as "Z" Muff provides an economical, efficient and durable way to protect ones hands in the exposed environment.

The unique Improved Hand Warming Device known as "Z" Muff is comprised essentially of a piece of "fur-like" cloth (natural or artificial) that is attached by a means (sewn, glued, or the like) to itself in a special configuration and then "inserted and stuffed" within itself to provide a new, special configuration for retaining heat and protecting ones hands. The newly invented device is configured to aid in cost efficient, durable and efficient product to achieve hand warming. In operation, the new device may be easily and quickly produced and used to protect ones hands from the cold environment.

B. Prior Art

Historically, hand warmers and muffs have not aimed to optimize the ease and economies of production. Also, they have failed to realize the improved configuration of having each hand engulfed in a secure and discrete "pocket". In use, the prior art devices were often limited in versatility, or complex in design and difficult to manufacture. The new Improved Hand Warming Device known as "Z" Muff address these limitations.

Examples of prior containers begin with U.S. Pat. No. 95,240 issued to Bernard Levy (1869). This teaches a multi-pocket device with complex sections and methods to produce. The drawings and specification indicate separate parts to the device which are connected to provide muff device. This differs from the Myers device by having multiple parts required to interconnect to produce the muff device. It lacks the simplicity of the Improved Hand Warming Device known as "Z" Muff and uses better the materials for the complete warming device. Another warming muff was issued to O. Kaehler as U.S. Pat. No. 405,097 (1889). It teaches an elaborately designed complex muff that requires multiple sub processes to produce separate hand chambers. The device also stresses and teaches integral yet additional support structures to accomplish the full concept of the device. The Myers device is simplified and accomplishes separate chambers with a unique, simplified sewing and "stuffing" procedure as discussed below with a closure system for the individual compartments.

Other examples of muffler devices with hand compartments include a U.S. Pat. No. 2,727,241 issued to J. W. Smith (1955) which teaches an elongated device with an integral mid-pouch for various warming means. The Myers device relies on warmth from each hand to be contained within the individual compartment and requires no supplemental heating means. A U.S. Pat. No. 4,408,355 issued to K. Brock (1983) teaches a device with a compartment for both hands which has a claimed unique waist mounting system. The mount is not addressed by the Myers device, yet the separate, high energy compartments by Myers offer significant improvements to the Brock device.

Another cold weather muff is taught in U.S. Pat. No. 4,495,659 issued to H. Madnick et al. It taught separate portions of the warmer device to receive heating means. The Myers device is self warming once a person's hands are placed within the device. The device taught by U.S. Pat. No. 4,862,519 by J. A. Ball shows a device coupled to a jacket. Further, the complex design shown with U.S. Pat. No. 5,269,023 demonstrates a complex approaches to warming devices when compared to the Myer's devices.

As far as known, there are no other hand warming devices at the present time which fully provide the improvements to the hand warming-type devices as completely as the present special Improved Hand Warming Device known as "Z" Muff. It is believed that this device is made with improved configuration and simplified physical connections and of a more durable design as compared to other currently utilized hand warming devices.

SUMMARY OF THE INVENTION

A special Improved Hand Warming Device known as "Z" Muff has been developed for use as an auxiliary accessory to be use to keep ones hands warm and safe from the elements. It is important to note that many variations in size, color and materials used are anticipated with this concept with only minor physical changes for manufacturing.

In a cold environment or a moderating environment with temperature variations and "swings" to cold exposures, a person often needs a means to protect ones hands from the severe cold temperature. This may be for a short or prolonged period of time. Specifically, the special Improved Hand Warming Device known as "Z" Muff provides an economical, efficient and durable way to protect ones hands in the exposed environment.

The preferred embodiment of the special Improved Hand Warming Device known as "Z" Muff is comprised essentially of a piece of "fur-like" cloth (natural or artificial) that is attached by a means (sewn, glued, or the like) to itself in a special configuration and then "inserted and stuffed" within itself to provide a new, special configuration for retaining heat and protecting ones hands.

The newly invented special Improved Hand Warming Device known as "Z" Muff is configured to aid in cost efficient, durable and efficient product to achieve hand warming. In operation, the new device may be easily and quickly produced and used to protect ones hands from the cold environment.

OBJECTS AND ADVANTAGES

There are several objects and advantages of the special Improved Hand Warming Device known as "Z" Muff device. There are currently no known hand warming devices that are effective at providing the objects of this invention.

The following TABLE A summarizes various advantages and objects of the special Improved Hand Warming Device known as "Z" Muff device. This list is exemplary and not limiting to the many advantages offered by this new device.

TABLE A

Various Advantages and Objects

| Item | Description of Advantage and Object |
|---|---|
| 1 | Rapid assembly of the device. |
| 2 | Simple tools for assembly. |
| 3 | Maximized use of the materials and minimal scrap. |
| 4 | Simple and efficient design for manufacturing. |
| 5 | Superior product design and heat retention results for the product. |

Finally, other advantages and additional features of the present special Improved Hand Warming Device known as "Z" Muff device will be more apparent from the accompanying drawings and from the full description of the device. For one skilled in the art of devices and improvements for hand warming, it is readily understood that the features shown in the examples with this device are readily adapted for improvement to other types of hand warming devices and auxiliary devices and systems.

DESCRIPTION OF THE DRAWINGS

Figures

The accompanying drawings, which are incorporated in and constitute a part of this specification, illustrate a preferred embodiment for the special Improved Hand Warming Device known as "Z" Muff device. The drawings together with the summary description given above and a detailed description given below serve to explain the principles of the special Improved Hand Warming Device known as "Z" Muff device. It is understood, however, that the device is not limited to only the precise arrangements and instrumentalities shown.

FIGS. 1A and B depict the general special Improved Hand Warming Device known as "Z" Muff device. FIG. 1C shows use of the device.

FIGS. 3A through 3D are sketches of the build of a special Improved Hand Warming Device known as "Z" Muff device in a progressive sequence of securing and forming the device.

FIGS. 5A and B and FIG. 1B are exemplary sketches of the special Improved Hand Warming Device known as "Z" Muff device in operation.

REFERENCE NUMERALS

Figures 2, 2A, 2B, 2C, 2D, 2E:
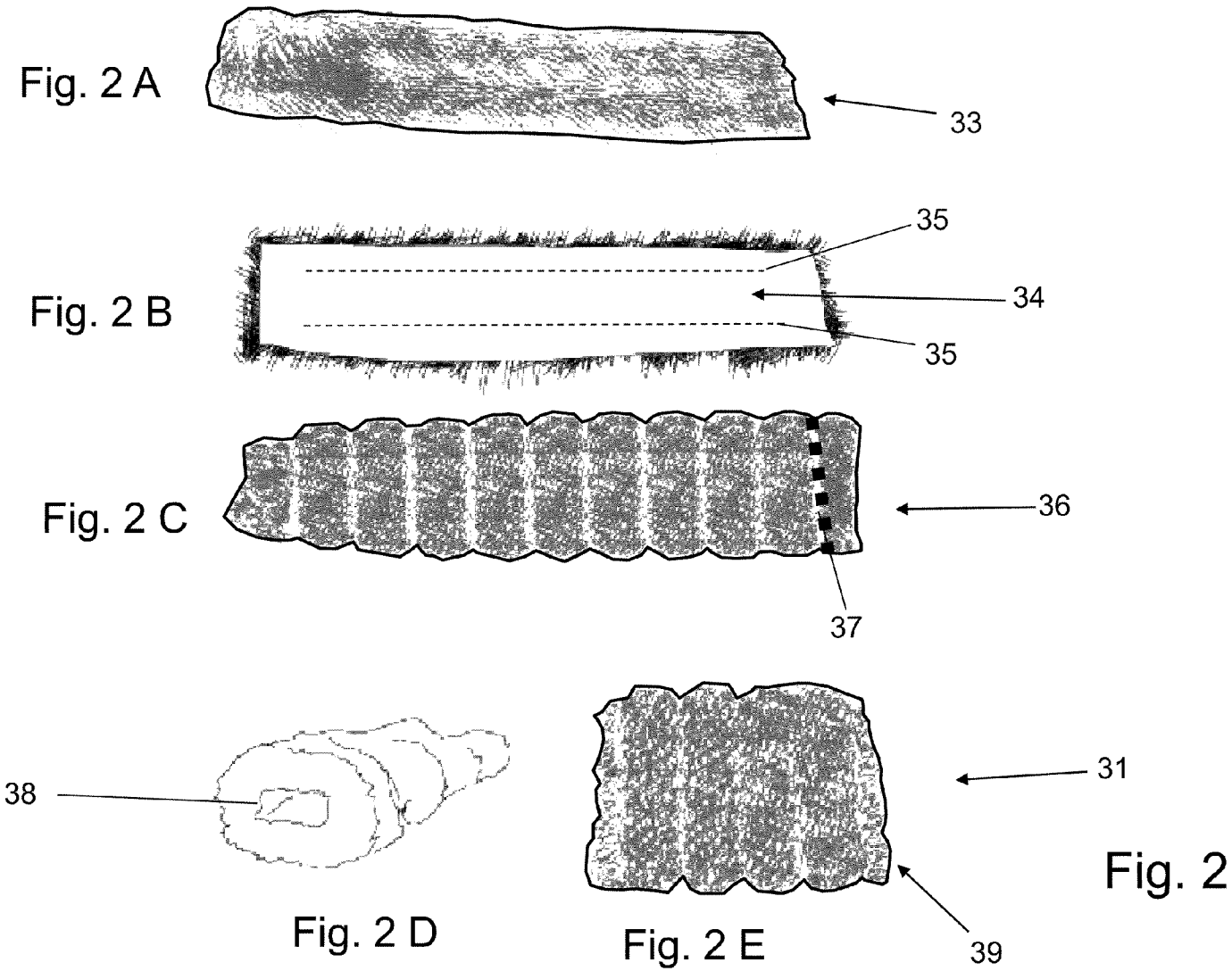
FIGS. 2A through 2E show the essential method to produce the special Improved Hand Warming Device known as "Z" Muff device in a progressive sequence.

The following list refers to the drawings:

| Ref # | Description |
|---|---|
| 31 | General special Improved Hand Warming Device known as "Z" Muff Device |
| 32 | Device User |
| 33 | Original full cloth section |
| 34 | Folded general device |
| 34A | Folded "closed" end of the general device |
| 35 | Side attachment means such as stitches |
| 36 | Inside - out and extended device 31 |
| 37 | End attachment means such as stitches |
| 38 | Partially "stuffed" device 31 |
| 39 | Fully "stuffed" device 31 |
| 40 | Fabricator/Operator |
| 41 | User Hand Positions |
| 42 | Sales/Marketing Advertisement |
| 43 | closed pocket |

DETAILED DESCRIPTION OF PREFERRED EMBODIMENT

The present mechanism is a special Improved Hand Warming Device known as "Z" Muff device 31 that has been developed for use to protect hands in a cold environment. The preferred embodiment 31 of the special Improved Hand Warming Device known as "Z" Muff is comprised essentially of a piece of "fur-like" cloth 33 (natural or artificial) that is attached by a means 35, 37 (sewn, glued, or the like) to itself in a special configuration and then "inserted and stuffed" within itself to provide a new, special configuration for retaining heat and protecting ones hands.

The improvement over the existing art is providing a device that:

a. has rapid assembly, b. has a superior product design' c. has superior heat retention' d. uses simplified tools for manufacturing, e. maximizes the use of material and minimizes scrap, and f. provides a simple and efficient design for manufacturing.

There is shown in FIGS. 1-6 a complete operative embodiment of the special Improved Hand Warming Device known as "Z" Muff device 31. In the drawings and illustrations, one notes well that the FIGS. 1-6 demonstrate the general configuration and use of this invention. The preferred embodiment of the improved device 31 is demonstrated in the drawings.

The preferred embodiment of the special Improved Hand Warming Device known as "Z" Muff device 31 is comprised essentially of a piece of "fur-like" cloth 33 (natural or artificial) that is attached by a means 35 and 37 (sewn, glued, or the like) to itself in a special configuration and then "inserted and stuffed" within itself to provide a new, special configuration for retaining heat and protecting ones hands. The cloth has a fluffy fur like side and a mat or skin-like side.

The accompanying drawings, which are incorporated in and constitute a part of this specification, illustrate an embodiment of the special Improved Hand Warming Device known as "Z" Muff device 31 that is preferred. The drawings together with the summary description given above and a detailed description given below serve to explain the principles of the special Improved Hand Warming Device known as "Z" Muff device 31. It is understood, however, that the special Improved Hand Warming Device known as "Z" Muff device 31 is not limited to only the precise arrangements and instrumentalities shown.

FIGS. 1A and B depict the general special Improved Hand Warming Device known as "Z" Muff device 31. FIG. 1C shows use of the device 31. In views FIGS. 1B and 1C, the device 31 is shown with the user 32.

FIGS. 2A through 2E show the essential method to produce the special Improved Hand Warming Device known as "Z" Muff device 31 in a progressive sequence. In FIG. 2A the process begins with a piece of cloth 33. This fur-like material is cut to predetermined length and width. This predetermined size results in minimal loss of scrap since full bolts of the material may be cut and the tolerances of the fabric over-all starting size is not critical. The fur-like material 33 may be artificial or real natural materials. One skilled in the art of working with fabrics well appreciates that many fabrics may be utilized within the scope and spirit of this device 31. In FIG. 2B, the second step of producing the device 31 is folding the cloth 33 in half length-wise or longitudinally along one folded closed end 34A with the fur to the inner side of the fold and creating a general device 34 which has the non-fur surface to the exterior surface or mat side or the cloth. This allows for an easy stitching 35 along each horizontal or longitudinal sides of the cloth 33. One sees in the drawing that the stitch runs nearly the full length of the device 31. Once each side is stitched, the device 31 is essentially a sack-like object with the fur to the inside of the object. Now the device 31 is turned "inside out" with the fur now being to the exterior of the sack-like object 36. This is shown in FIG. 2C. Now, on the open end of the inside-out object 36, an end stitch 37 or other means to close the inside-out object 36 and create the elongated object 31. In FIG. 2D, the one end is partially "stuffed inside of itself to form a partially stuffed device 38. Finally, the opposite end is stuffed inside to create the fully stuffed device 39 that is generally the Improved Hand Warming Device known as "Z" Muff device 31. This device 31 is shown in FIG. 2E. The stitching material may be of a simple yet heavy gauge cotton thread or an artificial thread or fiber made of nylon. Air Entangled Thread, Core Thread, Monocord Thread, Monofilament Thread, Spun Thread, Textured Thread, Twisted Multifilament Thread, Twisting "S" or "Z" patterns, or the like. The preferred is either a heavy gauge cotton core thread or mono filament nylon. Other examples of materials are polyester, acrylic, and composite fiber. These are exemplary and not to be construed as limitations to the type of thread used for the stitching 35 and 37. One skilled in the art of attaching and securing fabrics and cloths well appreciates other means such as gluing, pinning or plastic stapling may also work within the scope and spirit of the new device 31.

FIGS. 3A through 3D are sketches of the build of a special Improved Hand Warming Device known as "Z" Muff device in a progressive sequence of securing and forming the device. The process in FIG. 2, above, explained the way to sew the fabric 33 and produce the elongated device 36. This is shown in FIG. 3A. Next in FIGS. 3B and 3C, the fabricator 40 (or alternatively a machine if automated) begins to stuff one end to the interior creating a partially stuffed device 38. The completely stuffed device 31 or the Improved Hand Warming Device known as "Z" Muff device 31 is shown being held by the fabricator 40 in FIG. 3D. One notes the fur-like material is now inside the stuffed area and external to the Improved Hand Warming Device known as "Z" Muff device 31.

All of the details mentioned here are exemplary and not limiting. Other specific components specific to describing a special Improved Hand Warming Device known as "Z" Muff device 31 may be added as a person having ordinary skill in the field of hand warming devices well appreciates.

Operation of the Preferred Embodiment

The new special Improved Hand Warming Device known as "Z" Muff device 31 has been described in the above embodiment. The manner of how the device operates is described below. One skilled in the art and field of hand warming devices will note that the description above and the operation described here must be taken together to fully illustrate the concept of the special Improved Hand Warming Device known as "Z" Muff device 31.

The preferred embodiment of the special Improved Hand Warming Device known as "Z" Muff device 31 is comprised essentially of a piece of "fur-like" cloth (natural or artificial) that is attached by a means (sewn, glued, or the like) to itself in a special configuration and then "inserted and stuffed" within itself to provide a new, special configuration for retaining heat and protecting ones hands.

FIGS. 2A through 2E and FIGS. 3A through 3D show the essential method to produce the special Improved Hand Warming Device known as "Z" Muff device 31 in a progressive sequence. This is described above in the description section.

Figure 4B:
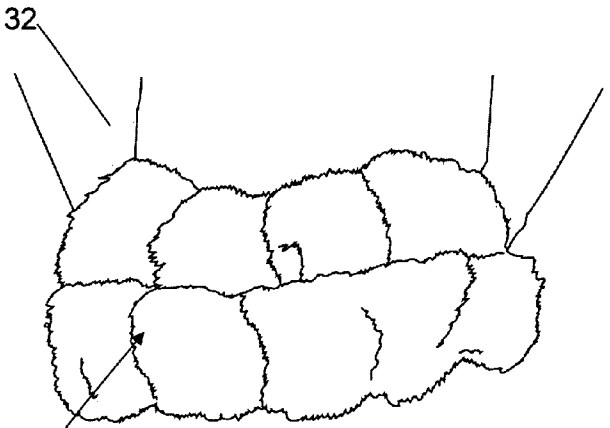
FIGS. 4A through 4C are sketches that show the special Improved Hand Warming Device known as "Z" Muff and the relation of the device to a user's hands.
Figure 4B:
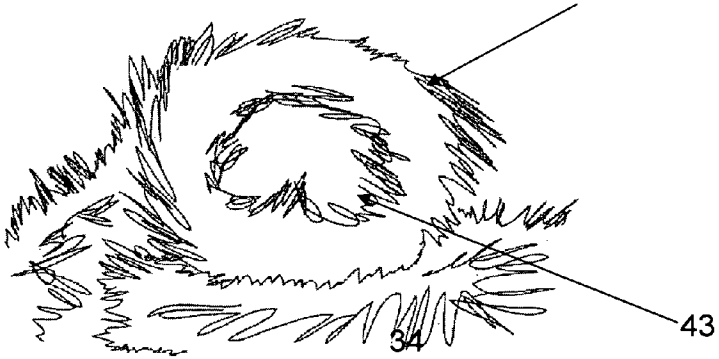
Figure 4C:
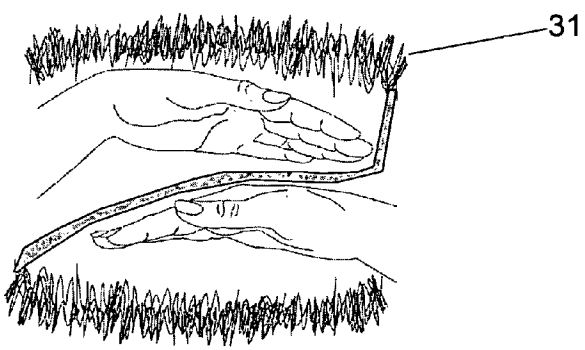
Figure 4A:
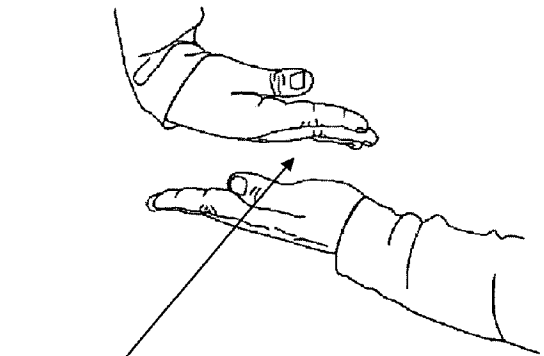
Figure 4:
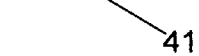

FIGS. 4A through 4C are sketches that show the special Improved Hand Warming Device known as "Z" Muff 31 and the relation of the device to a user's hands 41. In FIG. 1C, the Improved Hand Warming Device known as "Z" Muff device 31 was shown held by the user 32. In FIGS. 4A and 4C, the general position of the user's hands 41 are show. Theses are generally parallel. One understands from the description above that the ends of the elongated device 36 was "stuffed into itself" so that the result is a closed pocket 43 for each hand 41. This closed area is shown in FIG. 4B. This means that during use, each hand is separated and encased by a closed pocket 43 which has a fur-like encasement. The manner of forming these pockets (described above) and the resultant individual pockets 43 for each hand 41 provides the new and unique aspect of this concept for the Improved Hand Warming Device known as "Z" Muff device 31. One skilled in the art of hand warming devices appreciates the tight enclosed pocket provides a warming section. The difference is that most muffs are designed to keep ones hands warm by placing both of the hands inside the muff. The hands inside the muff may be warm but they are touching which undoubtedly causes them to sweat. With the new design of the Improved Hand Warming Device known as "Z" Muff device 31, there is a lining in the middle of the muff between each hand which in turn keeps the hands warm without them touching. This results in warmth without the sweat. The self contained, individual pockets need not use other warming devices such as hot packs and heat holding devices common in the sporting goods industry.

FIGS. 5A and B and FIG. 1B are exemplary sketches of the special Improved Hand Warming Device known as "Z" Muff device 31 in operation. Here the users 32 have their hands shown interior to the Improved Hand Warming Device known as "Z" Muff device 31.

Figure 6:
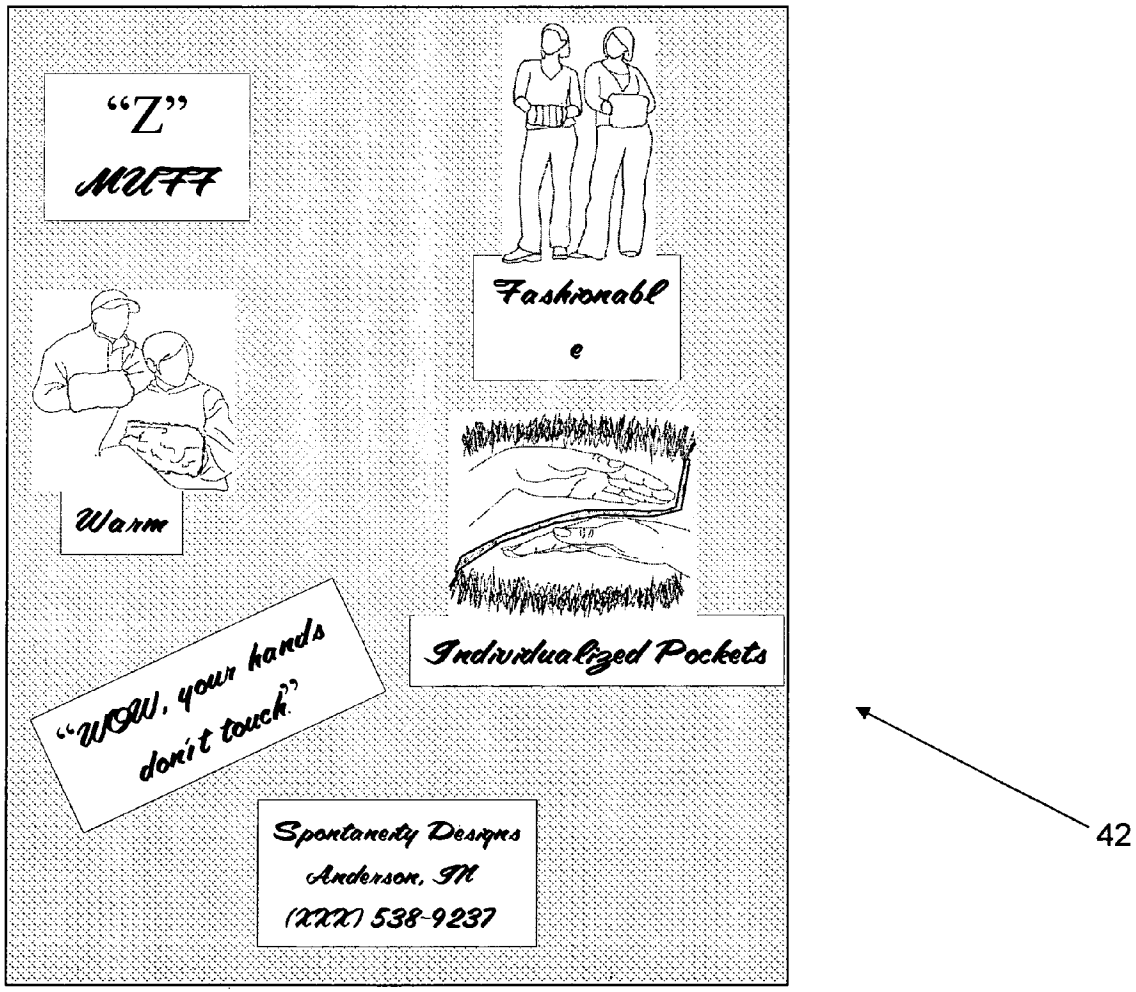
FIG. 6 is a sketch of the sales brochure that depict the special Improved Hand Warming Device known as "Z" Muff and shows ways to use the device.

FIG. 6 is a sketch of the sales brochure that depict the special Improved Hand Warming Device known as "Z" Muff 31 and shows ways to use the device. It is self explanatory.

With this description it is to be understood that the special Improved Hand Warming Device known as "Z" Muff device 31 is not to be limited to only the disclosed embodiment. The features of the special Improved Hand Warming Device known as "Z" Muff device 31 are intended to cover various modifications and equivalent arrangements included within the spirit and scope of the description.

The invention claimed is:

1. A method for making an improved hand warming device comprising:

a) STEP 1: Starting with a piece of fluffy and fur-like cloth;

b) STEP 2: Cutting the cloth to a predetermined length and width;

c) STEP 3: Folding the cloth in half forming a longitudinal cloth with one folded closed end with the fur to the inner side of the fold and creating the hand warming device which has the non-fur surface to the exterior surface of the device;

d) STEP 4: Stitching along each longitudinal side of the cloth forming an essentially sack-like object with the fur to the inside of the object;

e) STEP 5: Turning the sack-like object inside out with the fur now being to the exterior of the sack-like object;

f) STEP 6: Stitching an end stitch at the open end of the inside-out object and essentially creating an elongated object which is closed at each end;

g) STEP 7: Stuffing a first end partially inside of the object itself to form a first hand pocket; and h) STEP 8: Stuffing the opposite end partially inside of the object itself wherein the first hand pocket overlaps the second hand pocket.

* * * * *